US012460378B2

(12) United States Patent
Nishihara et al.

(10) Patent No.: US 12,460,378 B2
(45) Date of Patent: Nov. 4, 2025

(54) WORK MACHINE AND METHOD FOR CONTROLLING WORK MACHINE

(71) Applicant: KOMATSU LTD., Tokyo (JP)

(72) Inventors: Ken Nishihara, Tokyo (JP); Eiji Ishibashi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 58 days.

(21) Appl. No.: 18/554,681

(22) PCT Filed: May 31, 2022

(86) PCT No.: PCT/JP2022/022149
§ 371 (c)(1),
(2) Date: Oct. 10, 2023

(87) PCT Pub. No.: WO2023/276528
PCT Pub. Date: Jan. 5, 2023

(65) Prior Publication Data

US 2024/0191471 A1 Jun. 13, 2024

(30) Foreign Application Priority Data

Jun. 30, 2021 (JP) ..... 2021-108990

(51) Int. Cl.
*E02F 9/20* (2006.01)
*E02F 9/26* (2006.01)
*E02F 9/08* (2006.01)

(52) U.S. Cl.
CPC ..... *E02F 9/2029* (2013.01); *E02F 9/265* (2013.01); *E02F 9/0841* (2013.01)

(58) Field of Classification Search
CPC ..... E02F 9/2029; E02F 9/265; E02F 9/0841; E02F 3/7618; E02F 3/844; E02F 3/845; E02F 3/847; E02F 9/262; E02F 3/841
See application file for complete search history.

(56) References Cited

U.S. PATENT DOCUMENTS 5,950,141 A 9/1999 Yamamoto et al.
11,105,071 B2 * 8/2021 Ishibashi ..... E02F 9/262
(Continued)

FOREIGN PATENT DOCUMENTS

JP 52-142802 A 11/1977
JP 63-210315 A 9/1983
(Continued)

OTHER PUBLICATIONS

English translation of Written Opinion of the International Search Authority for PCT/JP2022/022149; date of mailing Aug. 23, 2022 . (Year: 2022).*

(Continued)

*Primary Examiner* — Calvin Cheung
(74) *Attorney, Agent, or Firm* — GLOBAL IP COUNSELORS, LLP

(57) ABSTRACT

A work machine includes a vehicle body, a lift frame rotatably supported about a lift axis, a blade rotatably supported about a pitch axis with respect to the lift frame, a lift actuator, a pitch actuator, a sensor detects a current blade tip position of the blade, and a controller. The controller acquires actual topography data indicative of an actual topography to be worked, acquires target topography data indicative of a target topography, and controls the lift actuator so that a blade tip of the blade moves according to the target topography. The controller controls the pitch actuator so that a pitch angle of the blade is changed based on a positional relationship in a vertical direction between any two of the actual topography corresponding to the current blade tip position, the target topography corresponding to the current blade tip position, and the current blade tip position.

20 Claims, 12 Drawing Sheets

(56) References Cited

U.S. PATENT DOCUMENTS

| | | | | |
|---|---|---|---|---|
| 11,408,149 | B2 * | 8/2022 | Ishibashi | E02F 9/205 |
| 2019/0194912 | A1 * | 6/2019 | Ishibashi | E02F 3/84 |
| 2021/0216075 | A1 | 7/2021 | Takaoka | |

FOREIGN PATENT DOCUMENTS

| | | | |
|---|---|---|---|
| JP | 63-108456 | U | 7/1988 |
| JP | 7-252859 | A | 10/1995 |
| JP | 9-209393 | A | 8/1997 |
| JP | 2020-84459 | A | 6/2020 |

OTHER PUBLICATIONS

JP 2020084459 A with English translation; date filed Nov. 19, 2018; date published Jun. 4, 2020. (Year: 2020).*
JP S63108456 U with English translation; date published Jul. 13, 1988. (Year: 1988).*
JP H063886 Y2 with English translation; date filed Dec. 27, 1986; date published Feb. 2, 1994. (Year: 1994).*
The International Search Report for the corresponding international application No. PCT/JP2022/022149, issued on Aug. 23, 2022.

* cited by examiner

WORK MACHINE AND METHOD FOR CONTROLLING WORK MACHINE

CROSS-REFERENCE TO RELATED APPLICATIONS

This application is a U.S. National stage application of International Application No. PCT/JP2022/022149, filed on May 31, 2022. This U.S. National stage application claims priority under 35 U.S.C. § 119(a) to Japanese Patent Application No. 2021-108990, filed in Japan on Jun. 30, 2021, the entire contents of which are hereby incorporated herein by reference.

BACKGROUND

The present invention relates to a work machine and a method for controlling a work machine.

BACKGROUND INFORMATION

In some work machines, a pitch angle of a blade can be adjusted according to an operation by an operator. For example, a work machine in Japanese Patent Application Publication No. H07-252859 is provided with an operating lever for adjusting the pitch angle of the blade. The operating lever is provided with a switch. Upon the operating lever being tilted to the right with the switch on, a hydraulic cylinder is controlled so that the blade is tilted forward (pitch dump). Upon the operating lever being tilted to the left with the switch on, the hydraulic cylinder is controlled so that the blade is tilted backward (pitch back).

SUMMARY

The pitch angle of the blade affects the work efficiency in digging work, leveling work, or the like. An appropriate pitch angle of the blade differs depending on the type of work. For example, when the pitch angle is small, that is, when the blade is tilted backward, the digging resistance is small and the digging performance is desirable, but the amount of soil that spills backward is large and the leveling performance is low. Conversely, when the pitch angle is large, that is, when the blade is tilted forward, the penetration force of the blade in a downward direction is large and the leveling performance is desirable, but the digging resistance is large and the digging performance is low.

Therefore, it is not easy for even a skilled operator to manually select an appropriate pitch angle accurately according to work. An object of the present disclosure is to make it possible to easily and appropriately adjust a pitch angle of a blade in a work machine according to work.

A work machine according to one aspect of the present invention includes a vehicle body, a lift frame, a blade, a lift actuator, a pitch actuator, a sensor, and a controller. The lift frame is supported so as to be rotatable about a lift axis with respect to the vehicle body. The blade is supported so as to be rotatable about a pitch axis with respect to the lift frame. The lift actuator causes the blade to perform a lift motion up and down about the lift axis. The pitch actuator causes the blade to perform a pitch motion about the pitch axis. The sensor detects a current blade tip position of the blade.

The controller acquires actual topography data indicative an actual topography to be worked. The controller acquires target topography data indicative of a target topography. The controller controls the lift actuator so that a blade tip of the blade moves according to the target topography. The controller controls the pitch actuator so that a pitch angle of the blade is changed based on a positional relationship in a vertical direction between any two of the actual topography corresponding to the current blade tip position, the target topography corresponding to the current blade tip position, or the current blade tip position.

A method according to another aspect of the present invention is a method for controlling a work machine. The work machine includes a vehicle body, a lift frame, a blade, a lift actuator, and a pitch actuator. The lift frame is supported so as to be rotatable about a lift axis with respect to the vehicle body. The blade is supported so as to be rotatable about a pitch axis with respect to the lift frame. The lift actuator causes the blade to perform a lift motion up and down about the lift axis. The pitch actuator causes the blade to perform a pitch motion about the pitch axis.

The method according to the present aspect includes detecting a current blade tip position of the blade, acquiring actual topography data indicative an actual topography to be worked, acquiring target topography data indicative of a target topography, controlling the lift actuator so that a blade tip of the blade moves according to the target topography, and controlling the pitch actuator so that a pitch angle of the blade is changed based on a positional relationship in a vertical direction between any two of the actual topography corresponding to the current blade tip position, the target topography corresponding to the current blade tip position, or the current blade tip position.

According to the present invention, the pitch angle of the blade is changed based on the positional relationship in the vertical direction between any two of the actual topography corresponding to the current blade tip position, the target topography corresponding to the current blade tip position, or the current blade tip position. The positional relationship in the vertical direction between any two of the actual topography, the target topography, or the current blade tip position differs depending on work performed by the work machine. Therefore, according to the present invention, the pitch angle of the blade can be easily and appropriately adjusted in the work machine according to work.

DETAILED DESCRIPTION OF EMBODIMENT(S)

Figure 1:
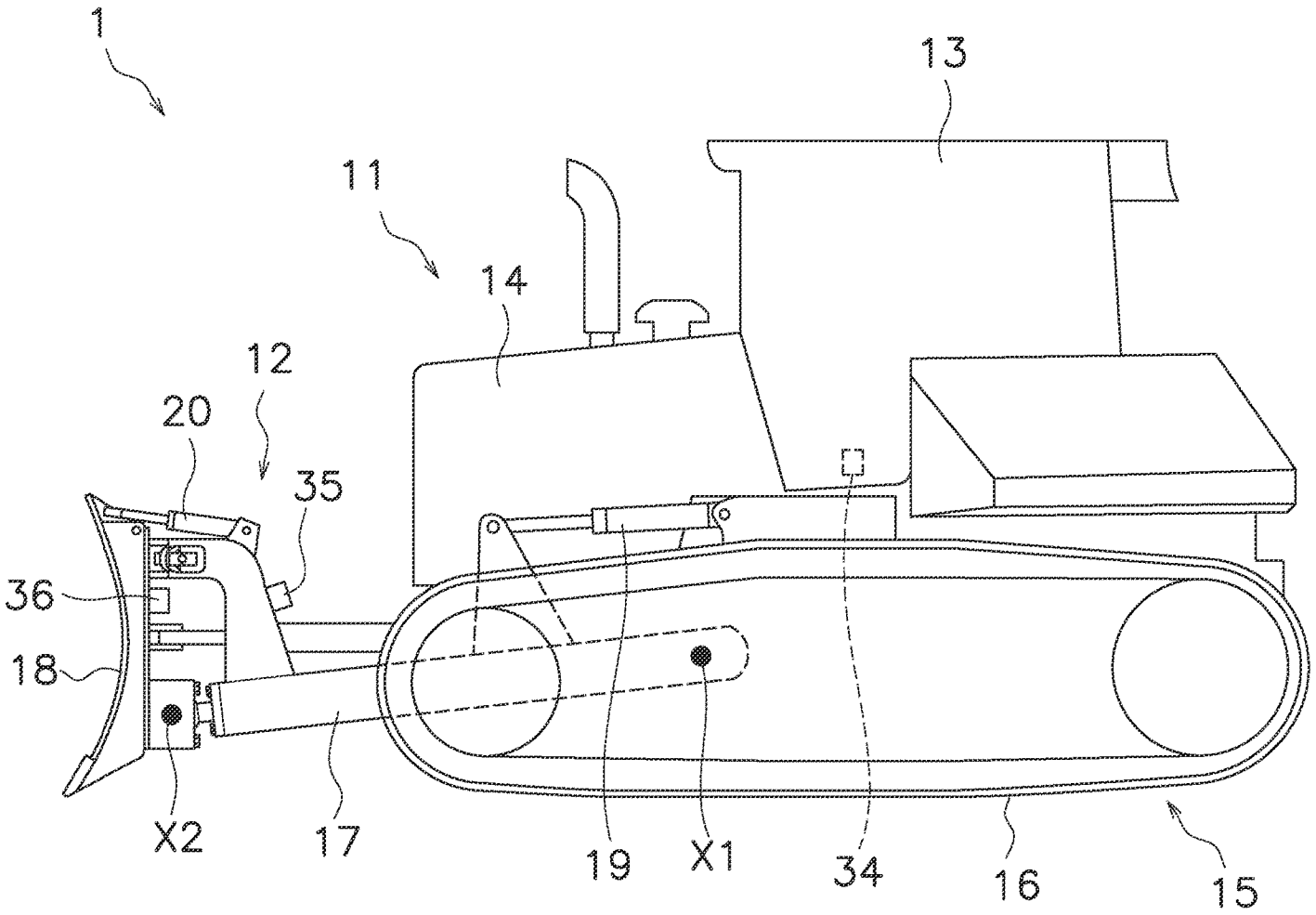
FIG. 1 is a side view of a work machine according to an embodiment.

A work machine according to an embodiment will be described below with reference to the drawings. FIG. 1 is a side view of a work machine 1 according to the embodiment. The work machine 1 according to the present embodiment is a bulldozer. The work machine 1 includes a vehicle body 11 and a work implement 12.

The vehicle body 11 includes an operating cabin 13, an engine compartment 14, and a travel device 15. An operator's seat that is not illustrated is disposed in the operating cabin 13. The engine compartment 14 is disposed in front of the operating cabin 13. The travel device 15 is provided at a lower portion of the vehicle body 11. The travel device 15 includes a pair of left and right crawler belts 16. Only the left crawler belt 16 is illustrated in FIG. 1. The work machine 1 travels due to the rotation of the crawler belts 16.

The work implement 12 is attached to the vehicle body 11. The work implement 12 includes a lift frame 17, a blade 18, a lift actuator 19, and a pitch actuator 20. The lift frame 17 is supported so as to be rotatable about a lift axis X1 with respect to the vehicle body 11. The lift axis X1 extends in a lateral direction of the vehicle body 11. The lift frame 17 rotates about the lift axis X1, thereby performing a lift motion up and down. The lift frame 17 may be attached to the travel device 15. The lift frame 17 may be disposed at an inner side of the travel device 15 or may be disposed at an outer side of the travel device 15.

The blade 18 is disposed in front of the vehicle body 11. The blade 18 is supported so as to be rotatable about a pitch axis X2 with respect to the lift frame 17. The pitch axis X2 extends in the lateral direction of the vehicle body 11. The blade 18 rotates about the pitch axis X2, thereby performing a pitch motion forward and backward. The blade 18 moves up and down accompanying the up and down motions of the lift frame 17.

The lift actuator 19 is coupled to the vehicle body 11 and the lift frame 17. The lift actuator 19 is a hydraulic cylinder. Due to the extension and contraction of the lift actuator 19, the lift frame 17 performs the lift motion up and down. The lift actuator 19 contracts, thereby causing the blade 18 to be raised. The lift actuator extends, thereby causing the blade 18 to be lowered. The lift actuator 19 may be attached to the blade 18.

The pitch actuator 20 is coupled to the lift frame 17 and the blade 18. The pitch actuator 20 is a hydraulic cylinder. Due to the extension and contraction of the pitch actuator 20, the blade 18 performs the pitch motion forward and backward. A portion of the blade 18, for example, its upper end moves forward and backward, thereby causing the blade 18 to perform the pitch motion about the pitch axis X2. The pitch actuator 20 extends, thereby causing the blade 18 to be tilted forward. The pitch actuator 20 contracts, thereby causing the blade 18 to be tilted backward.

Figure 2:
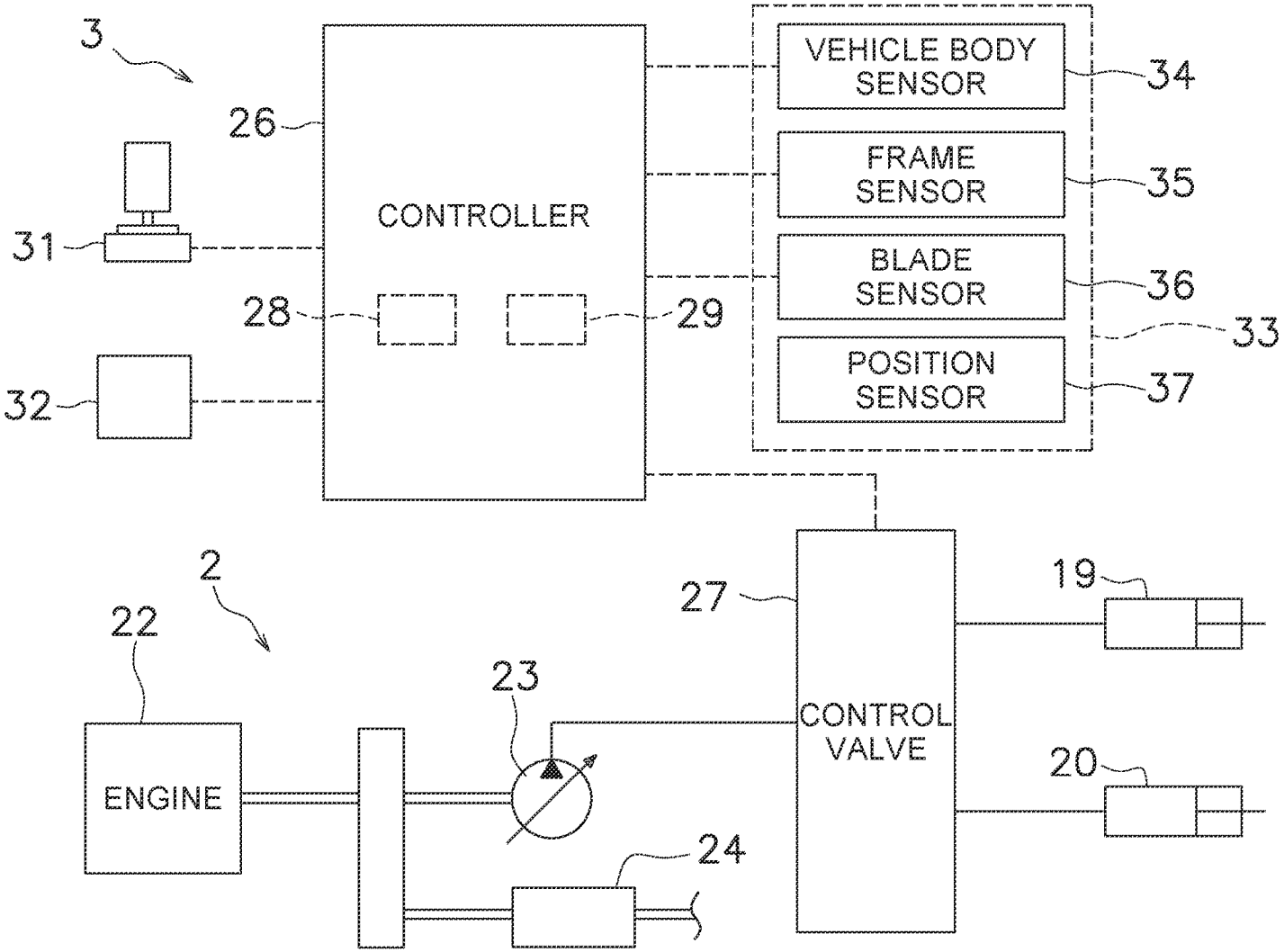
FIG. 2 is a block diagram illustrating a configuration of a drive system and a control system of the work machine.

FIG. 2 is a block diagram illustrating a configuration of a drive system 2 and a control system 3 of the work machine 1. As illustrated in FIG. 2, the drive system 2 includes an engine 22, a hydraulic pump 23 and a power transmission device 24. The hydraulic pump 23 is driven by the engine 22 to discharge hydraulic fluid. The hydraulic fluid discharged from the hydraulic pump 23 is supplied to the lift actuator 19 and the pitch actuator 20. Although one hydraulic pump is illustrated in FIG. 2, a plurality of hydraulic pumps may be provided.

The power transmission device 24 transmits driving force of the engine 22 to the travel device 15. The power transmission device 24 may be a hydro static transmission (HST), for example. Alternatively, the power transmission device 24 may be, for example, a transmission having a torque converter or a plurality of transmission gears.

The control system 3 includes a controller 26 and a control valve 27. The controller 26 is programmed to control the work machine 1 based on acquired data. The controller 26 includes a storage device 28 and a processor 29. The processor 29 includes a CPU, for example. The storage device 28 includes a memory and an auxiliary storage device, for example. The storage device 28 may be a RAM or a ROM, for example. The storage device 28 may be a semiconductor memory, a hard disk, or the like. The storage device 28 is an example of a non-transitory computer-readable recording medium. The storage device 28 stores computer instructions that are executable by the processor 29 and for controlling the work machine 1.

The control valve 27 is a proportional control valve and is controlled by a command signal from the controller 26. The control valve 27 is disposed between the hydraulic pump 23 and a hydraulic actuator such as the lift actuator 19 and the pitch actuator 20. The control valve 27 controls the flow rate of the hydraulic fluid supplied from the hydraulic pump 23 to the lift actuator 19. The control valve 27 controls the flow rate of the hydraulic fluid supplied from the hydraulic pump 23 to the pitch actuator 20. The control valve 27 may be a pressure proportional control valve. Alternatively, the control valve 27 may be an electromagnetic proportional control valve.

The control system 3 includes an operating device 31 and an input device 32. The operating device 31 includes a lever, for example. Alternatively, the operating device 31 may include a pedal or a switch. An operator can manually operate the travel of the work machine 1 and the motion of the work implement 12 using the operating device 31. The operating device 31 outputs an operation signal indicative of an operation of the operating device 31. The controller 26 receives the operation signal from the operating device 31.

The operating device 31 is configured to operate the lift motion of the blade 18. Specifically, the operating device 31 is configured to operate a raising operation and a lowering operation of the blade 18. When the operator performs the raising operation on the operating device 31, the controller 26 controls the lift actuator 19 so that the blade 18 is raised. When the operator performs the lowering operation on the operating device 31, the controller 26 controls the lift actuator 19 so that the blade 18 is lowered.

Figure 3:
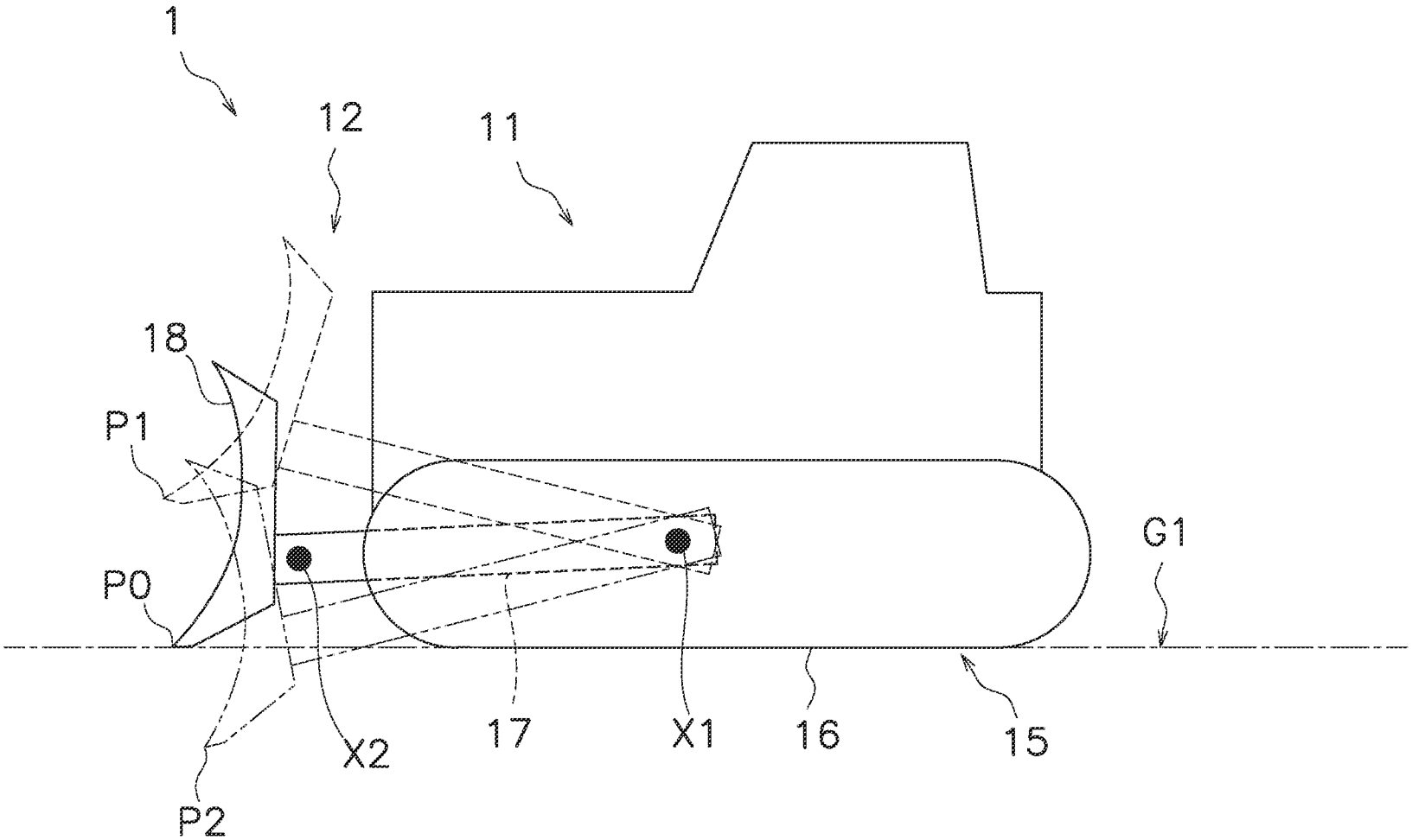
FIG. 3 is a view illustrating a lift motion of a blade.

FIG. 3 is a schematic view illustrating the lift motion of the work machine 1. In FIG. 3, P0 indicates a current position of a blade tip of the blade 18. P1 indicates the highest position of the blade tip of the blade 18. P2 indicates the lowest position of the blade tip of the blade 18. The work machine 1 can cause the blade 18 to perform the lift motion between the highest position P1 and the lowest position P2.

The operating device 31 is configured to operate the pitch motion of the blade 18. Specifically, the operating device 31 is configured to operate a forward tilt operation and a backward tilt operation of the blade 18. When the operator performs the forward tilt operation on the operating device 31, the controller 26 controls the pitch actuator 20 so that the blade 18 is tilted forward. When the operator performs the backward tilt operation on the operating device 31, the controller 26 controls the pitch actuator 20 so that the blade 18 is tilted backward.

Figures 4A, 4B, 4C:
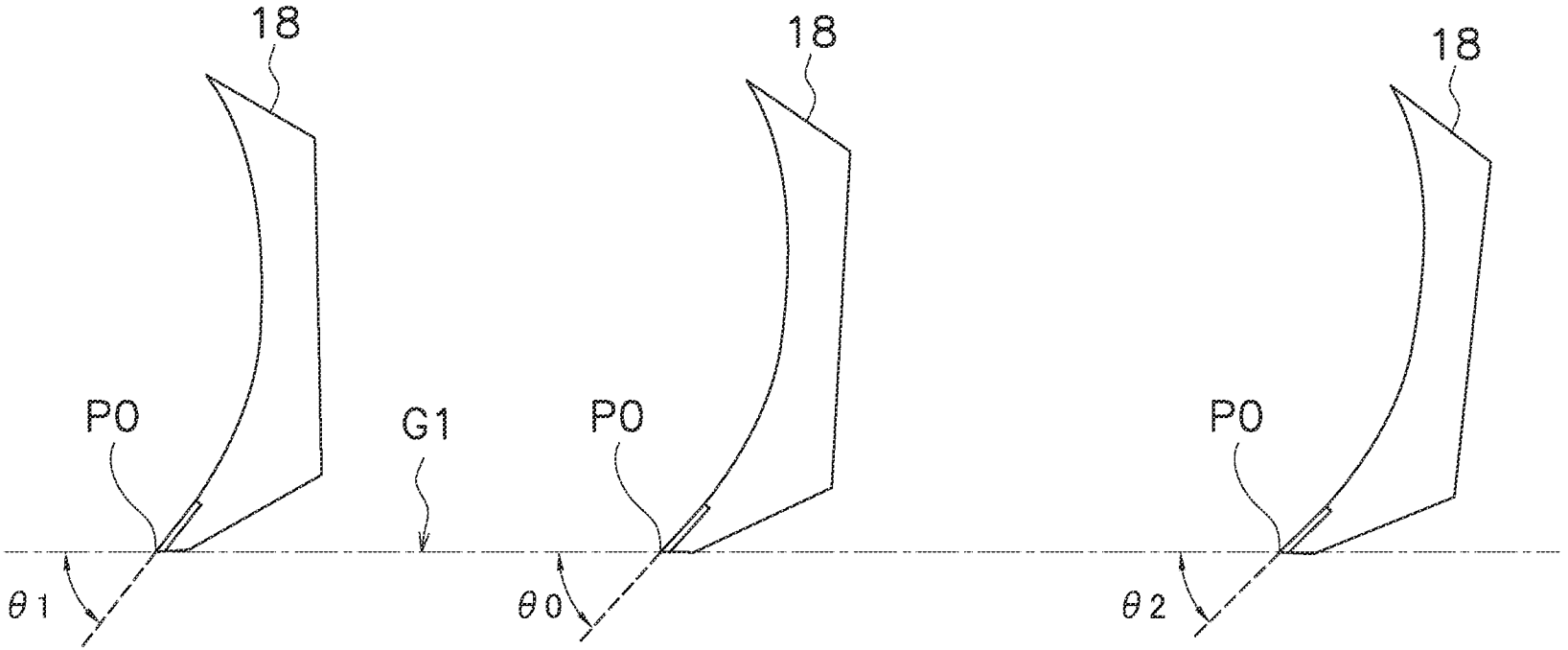
FIG. 4A, FIG. 4B and FIG. 4C are views illustrating a pitch motion of the blade.

FIGS. 4A to 4C are views illustrating pitch angles of the blade 18. As illustrated in FIGS. 4A to 4C, pitch angles θ0 to θ2 of the blade 18 are the angles between the blade tip of the blade 18 and a ground contact surface G1 of the crawler belts 16. FIG. 4B illustrates a pitch angle θ0 of the blade 18 in a normal state (hereinafter referred to as a "normal pitch angle"). FIG. 4A illustrates a pitch angle θ1 of the blade 18 tilted forward relative to the normal state. FIG. 4C illustrates a pitch angle θ2 of the blade 18 tilted backward relative to the normal state. The pitch angle increases as the blade 18 is tilted forward. The pitch angle decreases as the blade 18 is tilted backward. That is, the following formula θ1>θ0>θ2 is satisfied.

The operating device 31 may be a hydraulic pilot type device. For example, the operating device 31 may output pilot hydraulic pressure according to an operation of the operating device 31. The control valve 27 is controlled by the pilot hydraulic pressure from the operating device 31, whereby the lift actuator 19 or the pitch actuator 20 may be controlled. The controller 26 may receive a signal indicative of the pilot hydraulic pressure as the operation signal.

The input device 32 includes a touch screen, for example. The input device 32 may include another device such as a switch. The operator can set a control mode of the pitch angle of the blade 18 by the controller 26 using the input device 32. The control mode includes a manual mode and an automatic control. In the manual mode, the operator can manually change the pitch angle of the blade 18 using the operating device 31. The automatic control of the pitch angle will be described later in detail.

As illustrated in FIG. 2, the control system 3 includes a sensor 33 that detects a current position of the blade tip of the blade 18 (hereinafter referred to as a "blade tip position P0"). The sensor 33 includes a vehicle body sensor 34, a frame sensor 35, a blade sensor 36, and a position sensor 37. The vehicle body sensor 34 is attached to the vehicle body 11. The vehicle body sensor 34 detects a posture of the vehicle body 11. The frame sensor 35 is attached to the lift frame 17. The frame sensor 35 detects a posture of the lift frame 17. The blade sensor 36 is attached to the blade 18. The blade sensor 36 detects a posture of the blade 18. The position sensor 37 detects a current position of the vehicle body 11.

The vehicle body sensor 34, the frame sensor 35, and the blade sensor 36 are inertial measurement units (IMU). However, the frame sensor 35 and the blade sensor 36 are not limited to the IMU and may be another sensor such as an angle sensor, a cylinder stroke sensor, or the like.

The vehicle body sensor 34 detects an angle in the front-back direction of the vehicle body 11 with respect to the horizontal (vehicle pitch angle). The frame sensor 35 detects a rotation angle of the lift frame 17. The blade sensor 36 detects the pitch angle of the blade 18. The vehicle body sensor 34, the frame sensor 35, and the blade sensor 36 output detection signals indicative of the angles detected by the respective sensors.

The position sensor 37 is, for example, a position sensor of a global navigation satellite system (GNSS) such as a global positioning system (GPS). The position sensor 37 includes, for example, a GNSS receiver and an antenna. The position sensor 37 detects a current position of the position sensor 37. The position sensor 37 is disposed on the vehicle body 11. Accordingly, the position sensor 37 detects the current position of the vehicle body 11. The current position of the vehicle body 11 is indicated by global coordinates with the earth as a reference. However, the current position of the vehicle body 11 may be indicated by local coordinates with a work site where the work machine 1 performs work as a reference. The controller 26 acquires a detection signal indicative of the current position of the vehicle body 11 from the position sensor 37.

The controller 26 receives the detection signals from the vehicle body sensor 34, frame sensor 35, the blade sensor 36, and the position sensor 37. The controller 26 stores machine dimension data indicative of the dimensions of the vehicle body 11, the lift frame 17, and the blade 18 and their positional relationship. The controller 26 calculates the blade tip position P0 of the blade 18 based on the angles detected by the vehicle body sensor 34, the frame sensor 35, and the blade sensor 36, respectively, the current position of the vehicle body 11 detected by the position sensor 37, and the machine dimension data.

Figure 5:
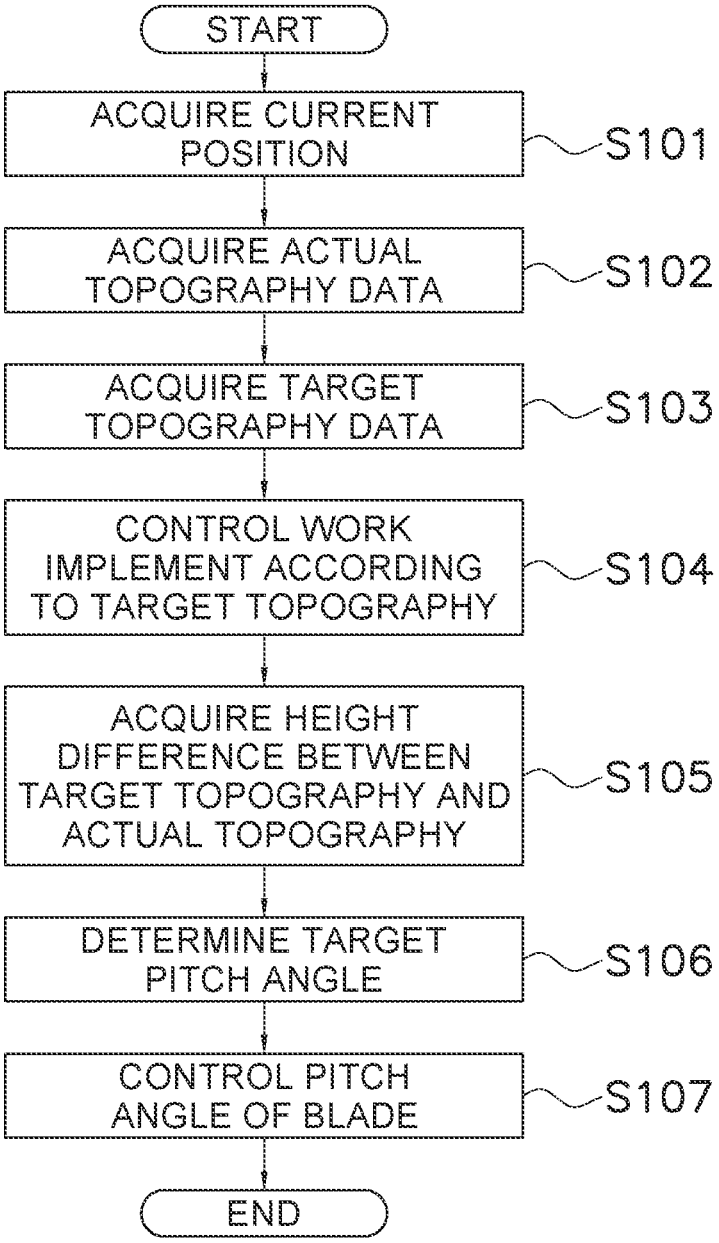
FIG. 5 is a flowchart illustrating an automatic control of the work machine according to a first embodiment.

The controller 26 automatically controls the work machine 1. The automatic control of the work machine 1 according to a first embodiment performed by the controller 26 will be described below. FIG. 5 is a flowchart illustrating processes of the automatic control according to the first embodiment.

As illustrated in FIG. 5, in step S101, the controller 26 acquires a current position of the work machine 1. At this time, the controller 26 acquires the above mentioned blade tip position P0 of the blade 18 as the current position of the work machine 1.

Figure 6:
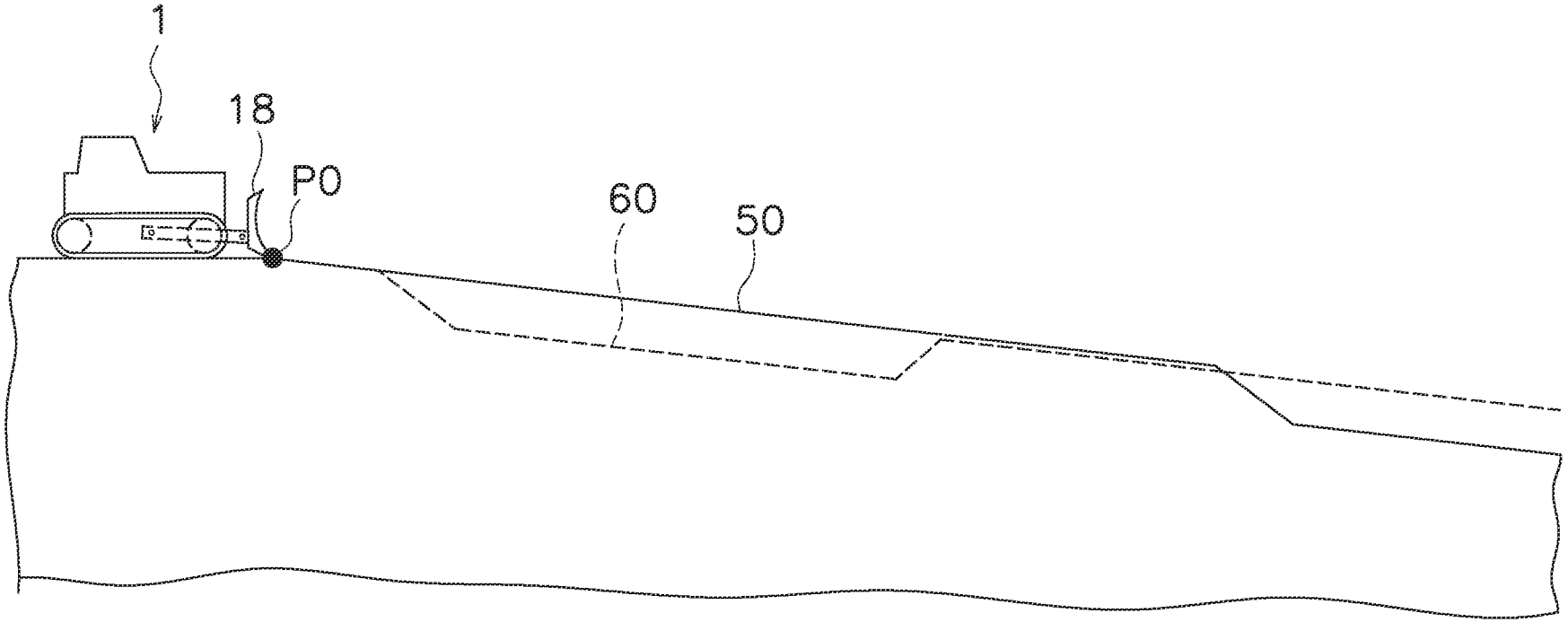
FIG. 6 is a view illustrating an example of an actual topography and a target topography.

In step S102, the controller 26 acquires actual topography data. The actual topography data indicates an actual topography 50 to be worked. FIG. 6 is a view illustrating an example of the actual topography 50. The actual topography data includes coordinates and heights of a plurality of points on the actual topography 50 positioned in a traveling direction of the work machine 1. The controller 26 may acquire the actual topography data from an external computer. The controller 26 may acquire the actual topography data updated with a trajectory of a bottom surface of the crawler belts 16.

In step S103, the controller 26 acquires target topography data. The target topography data indicates a target topography 60 with respect to the actual topography 50. The target topography data includes coordinates and heights of a plurality of points on the target topography 60 positioned in the traveling direction of the work machine 1. As illustrated in FIG. 6, at least a portion of the target topography 60 is vertically displaced with respect to the actual topography 50. At least a portion of the target topography 60 may match or substantially match the actual topography 50. At least a portion of the target topography 60 may be positioned above the actual topography 50. At least a portion of the target topography 60 may be positioned below the actual topography 50.

The controller 26 may determine the target topography 60 based on the actual topography 50. For example, the controller 26 may determine the target topography 60 by displacing the actual topography 50 upward or downward. The controller 26 may determine, as the target topography 60, a trajectory extending at a predetermined angle from a predetermined start position of work. The controller 26 may determine the target topography 60 based on the capacity of the blade 18 or a load applied to the blade 18. The controller 26 may determine the target topography 60 based on the amount of soil held by the blade 18. Alternatively, the controller 26 may acquire the target topography data from an external computer.

In step S104, the controller controls the work implement 12 according to the target topography 60. The controller 26 controls the lift actuator 19 so that the blade tip of the blade 18 moves according to the target topography 60. As a result, the blade 18 performs the lift motion up and down so that the blade tip of the blade 18 moves along the target topography 60 while the work machine 1 travels forward. The forward travel of the work machine 1 may be manually performed by the operator operating the operating device 31. Alternatively, the forward travel of the work machine 1 may be performed with the automatic control by the controller 26.

In the work machine 1 according to the present embodiment, the controller 26 performs the automatic control of the pitch angle while performing the automatic control of the height of the blade 18 according to the target topography 60. In the automatic control of the pitch angle, the controller 26 controls the pitch actuator so that the pitch angle of the blade 18 is changed based on a positional relationship in a vertical direction between the actual topography 50 and the target topography 60. Steps S105 to S107 explained below are processes of the automatic control of the pitch angle.

In step S105, the controller 26 acquires a height difference between the target topography 60 and the actual topography 50. The controller 26 calculates the height difference between the target topography 60 and the actual topography 50 from the target topography data and the actual topography data.

In step S106, the controller 26 determines a target pitch angle. In step S107, the controller 26 controls the pitch actuator 20 so that the pitch angle of the blade 18 is the target pitch angle.

Specifically, the controller 26 determines the target pitch angle based on the height difference between the target topography 60 and the actual topography 50. The controller 26 stores pitch angle data. The pitch angle data defines a relationship between the target pitch angle and the height difference between the target topography 60 and the actual topography 50. The pitch angle data is stored in the controller 26 in a format such as a map. The pitch angle data may be stored in the controller 26 in another format such as a formula, instead of the map.

Figure 7:
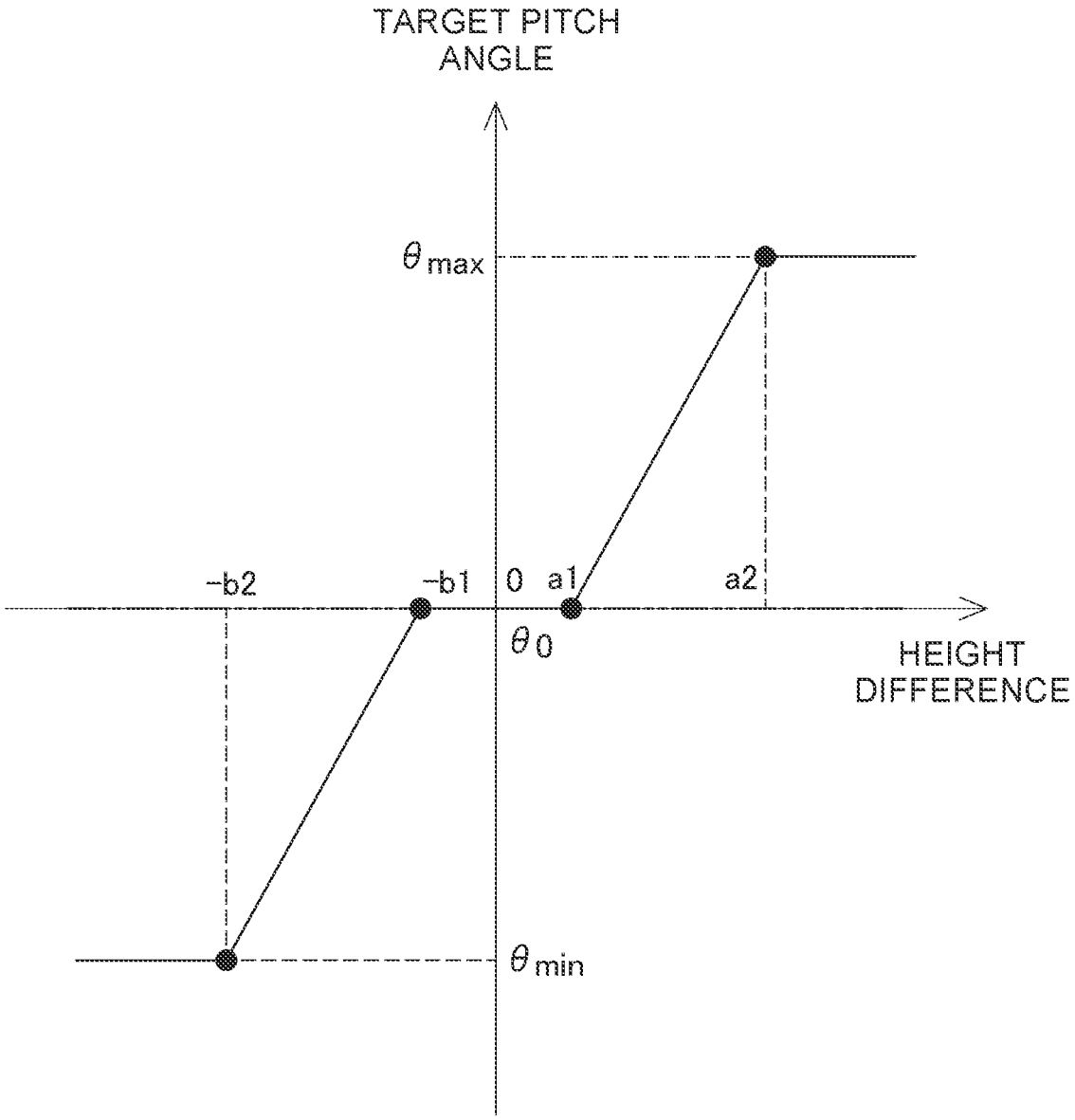
FIG. 7 is a graph illustrating an example of pitch angle data.

The controller 26 refers to the pitch angle data to determine the target pitch angle from the height difference between the target topography 60 and the actual topography 50. FIG. 7 is a graph illustrating an example of the pitch angle data. In FIG. 7, a solid line represents an example of the pitch angle data in the present embodiment. In FIG. 7, a chain double-dashed line represents a change in the pitch angle in a case where the automatic control of the pitch angle is not performed. That is, the chain double-dashed line in FIG. 7 represents a change in the pitch angle when the angle of the blade 18 with respect to the lift frame 17 is fixed (hereinafter referred to as a fixed pitch angle).

A height difference Hd1 is represented by the following formula (1).

$$Hd1=Ht-Ha \quad (1)$$

Ht is the height of the target topography 60. Ha is the height of the actual topography 50. Therefore, the fact that the height difference Hd1 is greater than zero means that the target topography 60 is positioned above the actual topography 50. The fact that the height difference Hd1 is less than zero means that the target topography 60 is positioned below the actual topography 50. The fact that the height difference Hd1 is zero means that the target topography 60 has the same height as the actual topography 50.

In FIG. 7, θmax represents a maximum pitch angle. That is, the maximum pitch angle θmax is a limit value of the pitch angle in a forward tilt direction. θmin indicates a minimum pitch angle. That is, the minimum pitch angle θmin is a limit value of the pitch angle in a backward tilt direction. A normal pitch angle θ0 is a value between the maximum pitch angle θmax and the minimum pitch angle θmin. When the pitch angle is fixed, as indicated by the chain double-dashed line in FIG. 7, the target pitch angle is constant at the normal pitch angle θ0 regardless of the height difference between the target topography 60 and the actual topography 50.

In the pitch angle data, when the height difference is a1 or less and −b1 or more, the target pitch angle is the normal pitch angle θ0. Therefore, when the target topography 60 is positioned in a predetermined range R0 in the vertical direction including the actual topography 50, the controller 26 sets the target pitch angle to the normal pitch angle θ0. The predetermined range R0 is a range between a position above the actual topography 50 by a distance a1 and a position below the actual topography 50 by a distance b1.

Figure 8:
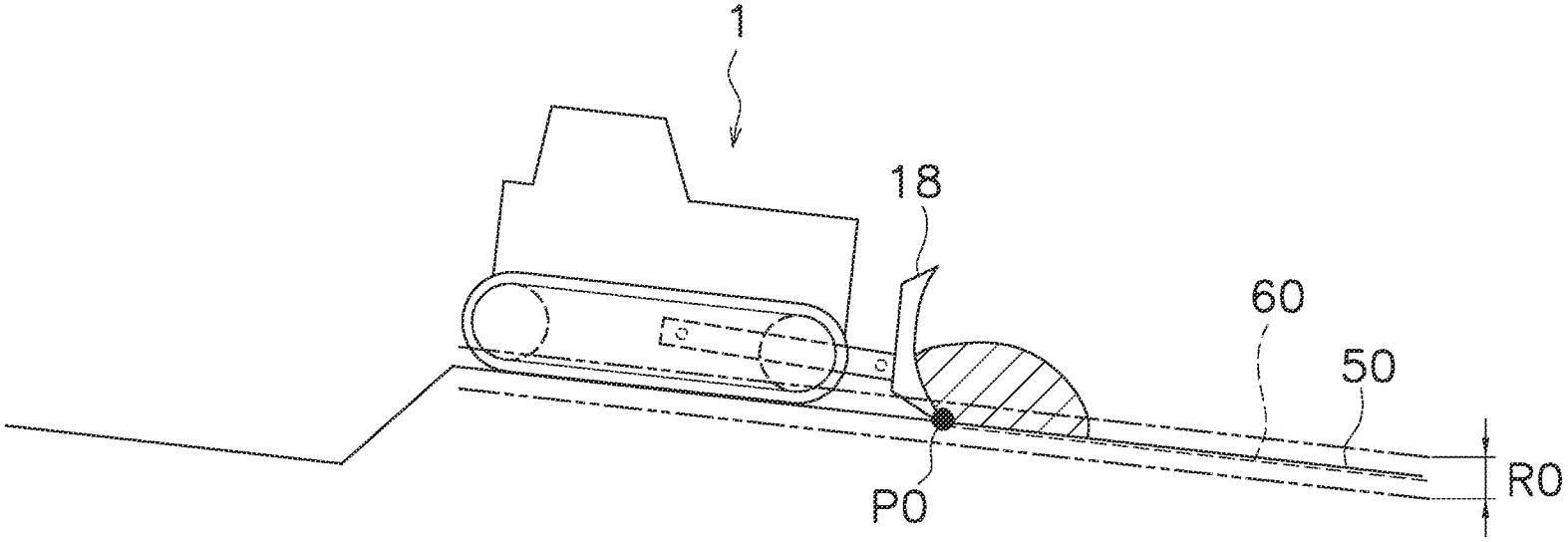
FIG. 8 is a view illustrating a motion of the blade when the target topography is positioned in a predetermined range.

Therefore, as illustrated in FIG. 8, when the target topography 60 is positioned in the predetermined range R0, the controller 26 causes the blade tip of the blade 18 to move according to the target topography 60, whereby the work machine 1 performs leveling work. At this time, the controller 26 sets the blade 18 to the normal pitch angle θ0.

In the pitch angle data, when the height difference is smaller than −b1, the target pitch angle is smaller than the normal pitch angle θ0 as illustrated in FIG. 7. Therefore, when the target topography 60 is positioned below the predetermined range R0, the controller 26 controls the pitch actuator 20 so that the pitch angle of the blade 18 is tilted backward relative to the normal state.

Figure 9:
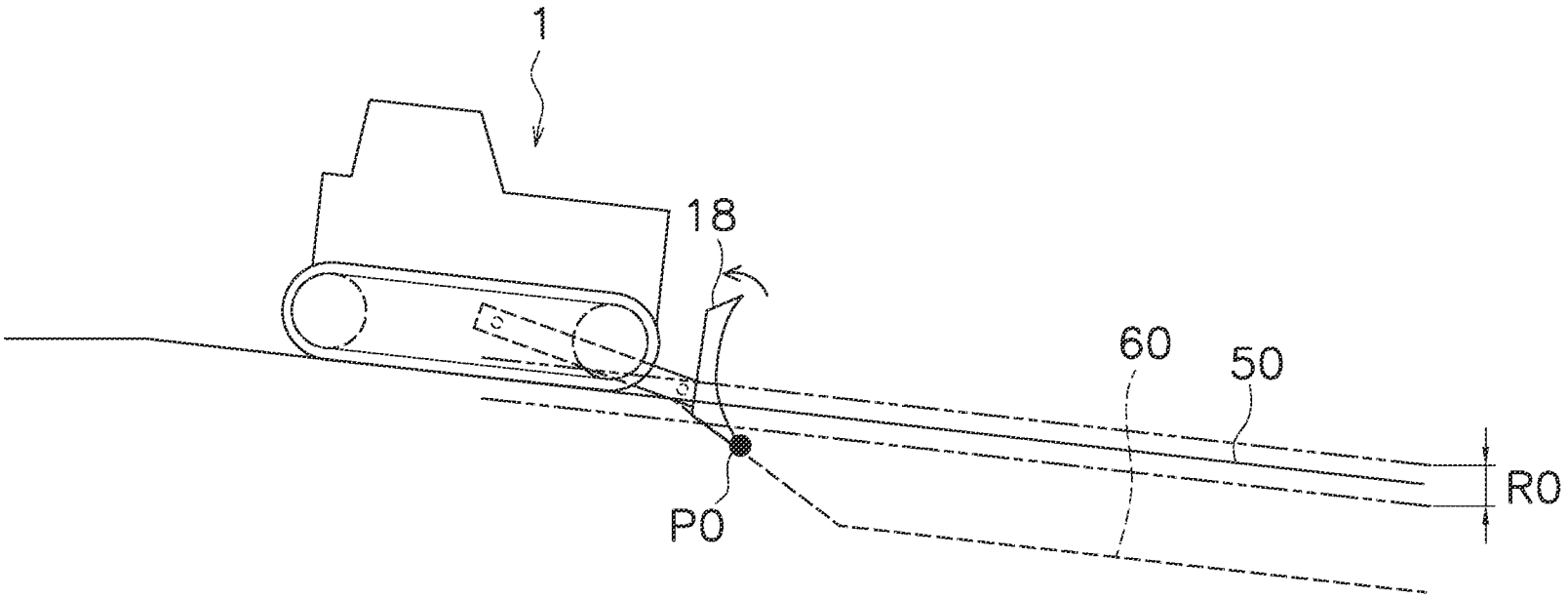
FIG. 9 is a view illustrating a motion of the blade when the target topography is positioned below the predetermined range.

Therefore, as illustrated in FIG. 9, when the target topography 60 is positioned below the predetermined range R0, the controller 26 causes the blade tip of the blade 18 to move according to the target topography 60, whereby the work machine 1 performs digging work. At this time, the controller 26 causes the blade 18 to be tilted backward relative to the normal pitch angle θ0. As a result, the digging resistance decreases, whereby the work efficiency is improved.

In the pitch angle data, when the height difference is smaller than −b1, the target pitch angle decreases as the height difference decreases. Therefore, when the target topography 60 is positioned below the predetermined range R0, the controller 26 changes the pitch angle of the blade 18 in the backward tilt direction according to an increase in an absolute value of the height difference. In the pitch angle data, when the height difference is smaller than −b2, the target pitch angle is constant at the minimum pitch angle θmin.

In the pitch angle data, when the height difference is larger than a1, the target pitch angle is larger than the normal pitch angle θ0 as illustrated in FIG. 7. Therefore, when the target topography 60 is positioned above the predetermined range R0, the controller 26 controls the pitch actuator 20 so that the pitch angle of the blade 18 is tilted forward relative to the normal state.

Figure 10:
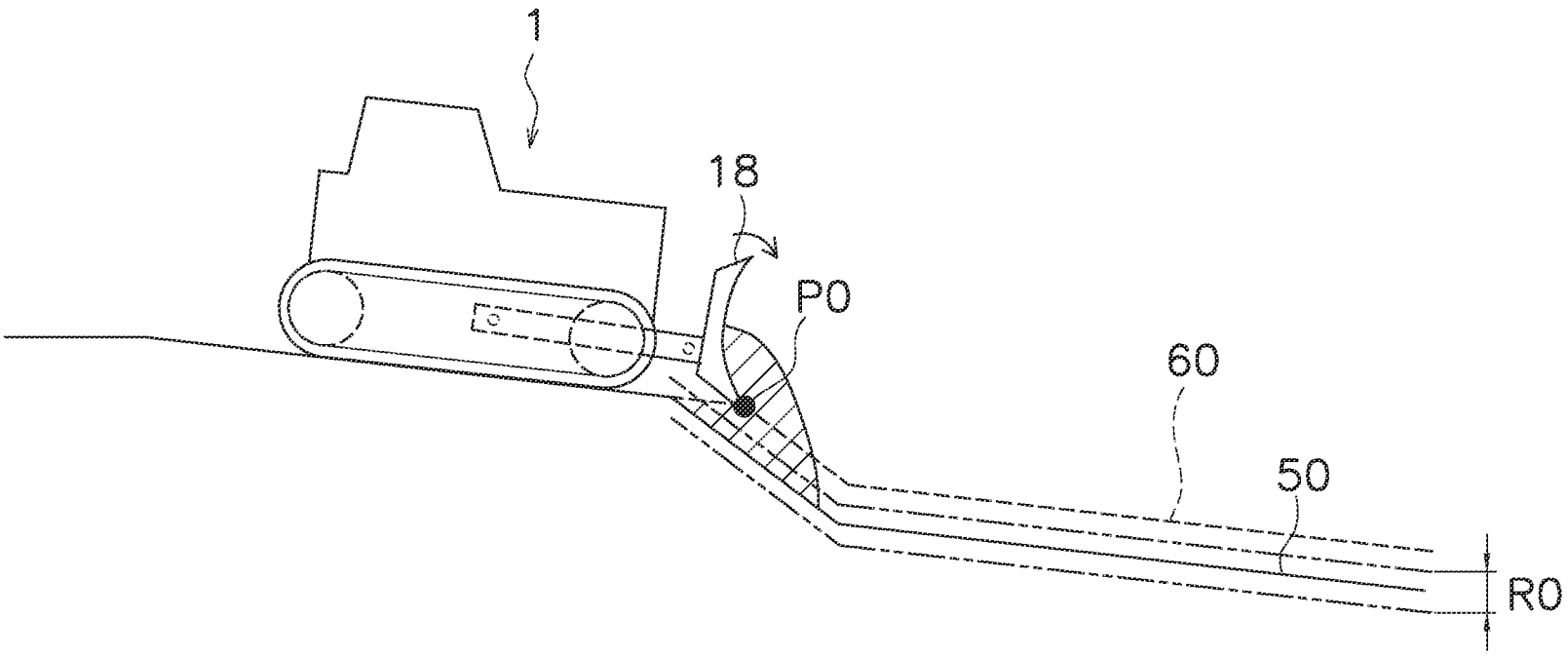
FIG. 10 is a view illustrating a motion of the blade when the target topography is positioned above the predetermined range.

Therefore, as illustrated in FIG. 10, when the target topography 60 is positioned above the predetermined range R0, the controller 26 causes the blade tip of the blade 18 to move according to the target topography 60, whereby the work machine 1 performs soil transportation work. At this time, the controller 26 causes the blade 18 to be tilted forward relative to the normal pitch angle θ0. As a result, the amount of soil that spills from the blade 18 decreases, whereby the work efficiency in the soil transportation is improved.

In the pitch angle data, when the height difference is larger than a1, the target pitch angle increases as the height difference increases. Therefore, when the target topography 60 is positioned above the predetermined range R0, the controller 26 changes the pitch angle of the blade 18 in the forward tilt direction according to an increase in an absolute value of the height difference. In the pitch angle data, when the height difference is larger than a2, the target pitch angle is constant at the maximum pitch angle θmax.

The processes in steps S105 to S106 may be performed after the process in step S104 is started. That is, the controller 26 may change the pitch angle of the blade 18 with the automatic control while causing the blade 18 to move according to the target topography 60. Alternatively, the processes in steps S105 to S106 may be performed before the process in step S104 is started. That is, the controller 26 may change the pitch angle of blade 18 with the automatic control before causing the blade 18 to move according to the target topography 60.

In the work machine 1 according to the present embodiment as described above, the pitch angle of the blade 18 is changed based on the positional relationship in the vertical direction between the actual topography 50 and the target topography 60. The positional relationship in the vertical direction between the actual topography 50 and the target topography 60 differs depending on work performed by the work machine 1. Therefore, in the work machine 1 according to the present embodiment, the pitch angle of the blade 18 can be easily and appropriately adjusted according to work.

Figure 11:
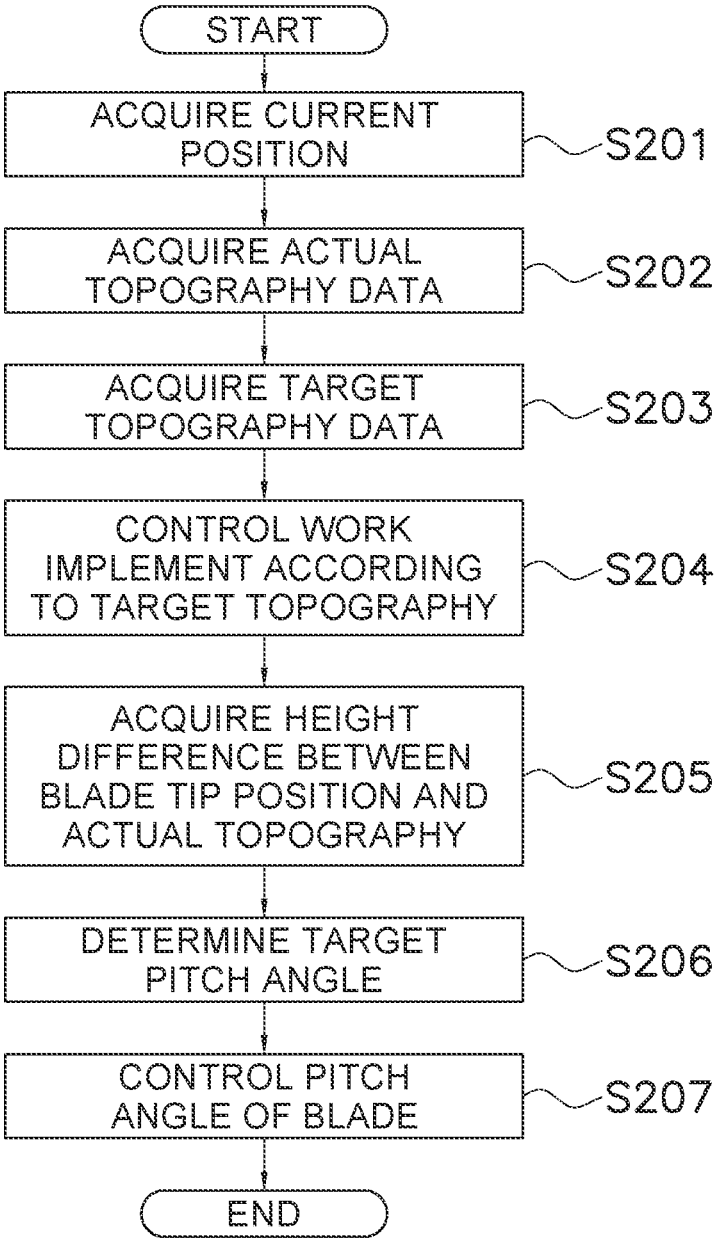
FIG. 11 is a flowchart illustrating the automatic control of the work machine according to a second embodiment.

Next, the automatic control of the pitch angle according to a second embodiment will be described. In the automatic control of the pitch angle according to the second embodiment, the controller 26 controls the pitch actuator 20 so that the pitch angle of the blade 18 is changed based on a positional relationship in the vertical direction between the blade tip position P0 and the actual topography 50. FIG. 11 is a flowchart illustrating processes of the automatic control according to the second embodiment. In FIG. 11, steps S201 to S204 are the same as steps S101 to S104 in the first embodiment described above.

In step S205, the controller 26 acquires a height difference between the blade tip position P0 and the actual topography 50. The controller 26 calculates the height difference between the blade tip position P0 and the actual topography 50 from the actual topography data and the height of the blade tip position P0. A height difference Hd2 is represented by the following formula (2).

$$Hd2=Hp-Ha \quad (2)$$

Hp is the height of the blade tip position P0. Ha is the height of the actual topography 50. Therefore, the fact that the height difference Hd2 is greater than zero means that the blade tip position P0 is positioned above the actual topography 50. The fact that the height difference Hd2 is less than zero means that the blade tip position P0 is positioned below the actual topography 50. The fact that the height difference Hd2 is zero means that the blade tip position P0 has the same height as the actual topography 50.

In step S206, the controller 26 determines the target pitch angle. The controller 26 determines the target pitch angle based on the height difference between the blade tip position P0 and the actual topography 50. The controller 26 refers to the pitch angle data to determine the target pitch angle in the same manner as the first embodiment. In the second embodiment, the pitch angle data defines a relationship between the target pitch angle and the height difference between the blade tip position P0 and the actual topography 50. Since the pitch angle data in the second embodiment is the same as the pitch angle data in the first embodiment described above, the detailed description thereof will be omitted.

In step S207, the controller 26 controls the pitch actuator 20 so that the pitch angle of the blade 18 is the target pitch angle. As in FIG. 8, when the blade tip position P0 is positioned in the predetermined range R0 in the vertical direction including the actual topography 50, the controller 26 sets the target pitch angle to the normal pitch angle θ0. Therefore, when the blade tip position P0 is positioned in the predetermined range R0, the controller 26 causes the blade tip of the blade 18 to move according to the target topography 60, whereby the work machine 1 performs the leveling work. At this time, the controller 26 sets the blade 18 to the normal pitch angle θ0.

As in FIG. 9, when the blade tip position P0 is positioned below the predetermined range R0, the controller 26 controls the pitch actuator 20 so that the pitch angle of the blade 18 is tilted backward relative to the normal state. Therefore, when the blade tip position P0 is positioned below the predetermined range R0, the controller 26 causes the blade tip of the blade 18 to move according to the target topography 60, whereby the work machine 1 performs the digging work. At this time, the controller 26 causes the blade 18 to be tilted backward relative to the normal pitch angle θ0. Further, when the blade tip position P0 is positioned below the predetermined range R0, the controller 26 changes the pitch angle of the blade 18 in the backward tilt direction according to an increase in an absolute value of the height difference.

As in FIG. 10, when the blade tip position P0 is positioned above the predetermined range R0, the controller 26 controls the pitch actuator 20 so that the pitch angle of the blade 18 is tilted forward relative to the normal state. Therefore, the controller 26 causes the blade tip of the blade 18 to move according to the target topography 60, whereby the work machine 1 performs the soil transportation work. At this time, the controller 26 causes the blade 18 to be tilted forward relative to the normal pitch angle θ0. Further, when the blade tip position P0 is positioned above the predetermined range R0, the controller 26 changes the pitch angle of the blade 18 in the forward tilt direction according to an increase in an absolute value of the height difference.

The processes in steps S205 to S206 are performed after the process in step S204 is started. That is, the controller 26 changes the pitch angle of the blade 18 with the automatic control while causing the blade 18 to move according to the target topography 60.

In the automatic control of the pitch angle according to the second embodiment as described above, the pitch angle of the blade 18 is changed based on the positional relationship in the vertical direction between the blade tip position P0 and the actual topography 50. The positional relationship in the vertical direction between the blade tip position P0 and the actual topography 50 differs depending on work performed by the work machine 1. Therefore, in the work machine 1 according to the present embodiment, the pitch angle of the blade 18 can be easily and appropriately adjusted according to work.

Figure 12:
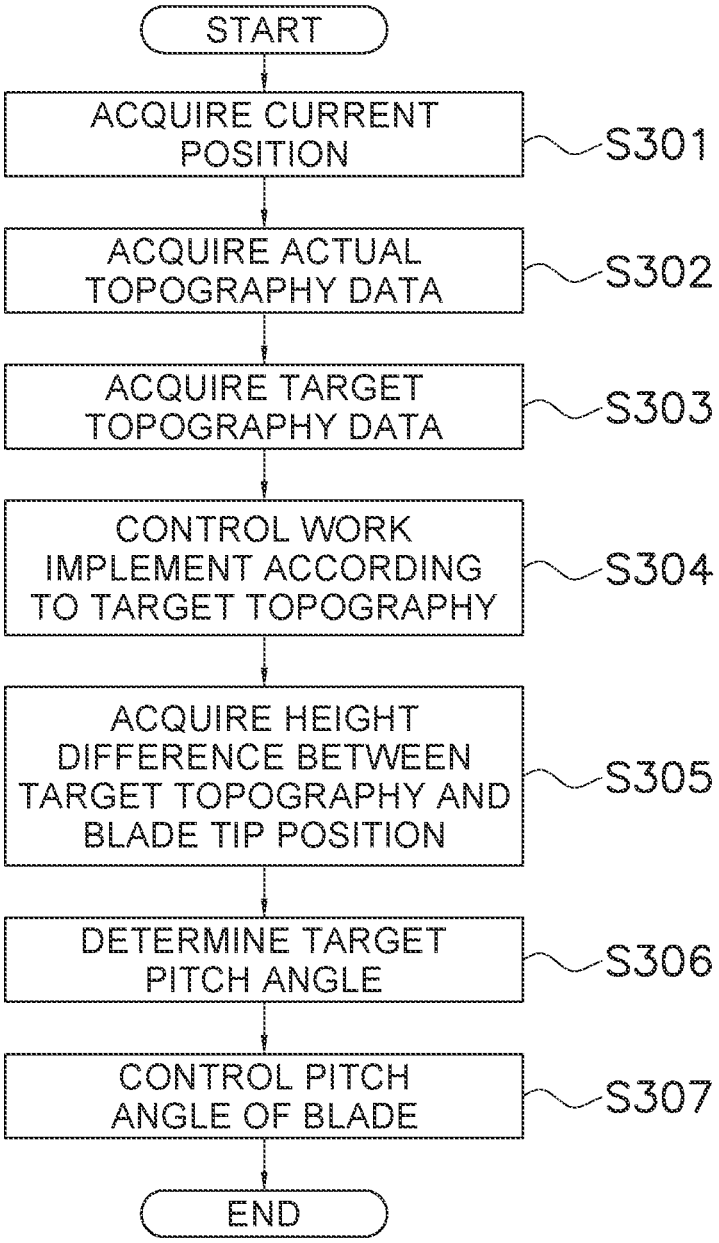
FIG. 12 is a flowchart illustrating the automatic control of the work machine according to a third embodiment.

Next, the automatic control of the pitch angle according to a third embodiment will be described. In the automatic control of the pitch angle according to the third embodiment, the controller 26 controls the pitch actuator 20 so that the pitch angle of the blade 18 is changed based on a positional relationship in the vertical direction between the target topography 60 and the blade tip position P0. FIG. 12 is a flowchart illustrating processes of the automatic control according to the third embodiment. In FIG. 12, steps S301 to S304 are the same as steps S101 to 104 in the first embodiment described above.

In step S305, the controller 26 acquires a height difference between the target topography 60 and the blade tip position P0. The controller 26 calculates the height difference between the target topography 60 and the blade tip position P0 from the target topography data and the height of the blade tip position P0. A height difference Hd3 is represented by the following formula (3).

$$Hd3=Ht-Hp \quad (3)$$

Ht is the height of the target topography 60. Hp is the height of the blade tip position P0. Therefore, the fact that the height difference Hd3 is greater than zero means that the target topography 60 is positioned above the blade tip position P0. The fact that the height difference Hd3 is less than zero means that the target topography 60 is positioned below the blade tip position P0. The fact that the height difference Hd3 is zero means that the target topography 60 has the same height as the blade tip position P0.

In step S306, the controller 26 determines the target pitch angle. The controller 26 determines the target pitch angle based on the height difference between the target topography 60 and the blade tip position P0. The controller 26 refers to the pitch angle data to determine the target pitch angle in the same manner as the first embodiment. In the third embodiment, the pitch angle data defines a relationship between the target pitch angle and the height difference between the target topography 60 and the blade tip position P0. Since the pitch angle data in the third embodiment is the same as the pitch angle data in the first embodiment described above, the detailed description thereof will be omitted.

In step S307, the controller 26 controls the pitch actuator 20 so that the pitch angle of the blade 18 is the target pitch angle. As in FIG. 8, when the target topography 60 is positioned in the predetermined range R0 in the vertical direction including the blade tip position P0, the controller 26 sets the target pitch angle to the normal pitch angle θ0. Therefore, when the target topography 60 is positioned in the predetermined range R0, the controller 26 causes the blade tip of the blade 18 to move according to the target topography 60, whereby the work machine 1 performs the leveling work. At this time, the controller 26 sets the blade 18 to the normal pitch angle θ0.

As in FIG. 9, when the target topography 60 is positioned below the predetermined range R0, the controller 26 controls the pitch actuator 20 so that the pitch angle of the blade 18 is tilted backward relative to the normal state. Therefore, when the target topography 60 is positioned below the predetermined range R0, the controller 26 causes the blade tip of the blade 18 to move according to the target topography 60, whereby the work machine 1 performs the digging work. At this time, the controller 26 causes the blade 18 to be tilted backward relative to the normal pitch angle θ0. Further, when the target topography 60 is positioned below the predetermined range R0, the controller 26 changes the pitch angle of the blade 18 in the backward tilt direction according to an increase in an absolute value of the height difference.

As in FIG. 10, when the target topography 60 is positioned above the predetermined range R0, the controller 26 controls the pitch actuator 20 so that the pitch angle of the blade 18 is tilted forward relative to the normal state. Therefore, the controller 26 causes the blade tip of the blade 18 to move according to the target topography 60, whereby the work machine 1 performs the soil transportation work. At this time, the controller 26 causes the blade 18 to be tilted forward relative to the normal pitch angle θ0. Further, when the target topography 60 is positioned above the predetermined range, the controller 26 changes the pitch angle of the blade 18 in the forward tilt direction according to an increase in an absolute value of the height difference.

The processes in steps S305 to S306 are performed after the process in step S304 is started. That is, the controller 26 changes the pitch angle of the blade 18 with the automatic control while causing the blade 18 to move according to the target topography 60.

In the automatic control of the pitch angle according to the third embodiment as described above, the pitch angle of the blade 18 is changed based on the positional relationship in the vertical direction between the target topography 60 and the blade tip position P0. The positional relationship in the vertical direction between the target topography 60 and the blade tip position P0 differs depending on work performed by the work machine 1. Therefore, in the work machine 1 according to the present embodiment, the pitch angle of the blade 18 can be easily and appropriately adjusted according to work.

Although one embodiment of the present invention has been described above, the present invention is not limited to the above embodiment and various modifications are possible without departing from the gist of the invention.

The work machine 1 is not limited to a bulldozer and may be another vehicle such as a wheel loader, a motor grader, or the like. The controller 26 may have a plurality of controllers separate from each other. A portion of the plurality of controllers may be disposed outside of the work machine 1. That is, the work machine 1 may be able to be remotely controlled. The processes by the controller 26 are not limited to those in the above embodiments and may be changed. A portion of the above processes of the automatic control may be omitted. Alternatively, a portion of the above processes may be changed.

The lift actuator 19 and the pitch actuator 20 are not limited to hydraulic cylinders. The lift actuator 19 and the pitch actuator 20 may be another actuator such as an electric motor, for example. The position sensor 37 may be disposed on another part of the work machine 1, instead of the vehicle body 11. For example, the position sensor 37 may be disposed on the blade 18.

The pitch angle data is not limited to that in the above embodiments and may be changed. For example, the pitch angle data may define only the relationship between the height difference and the target pitch angle in the digging work and the leveling work. The pitch angle data may define only the relationship between the height difference and the target pitch angle in the leveling work and the soil transportation work. The pitch angle data may define only the relationship between the height difference and the target pitch angle in the digging work and the soil transportation work. Alternatively, the pitch angle data may define the relationship between the height difference and the target pitch angle in other work.

According to the present invention, the pitch angle of the blade can be easily and appropriately adjusted in the work machine according to work.

The invention claimed is:

1. A work machine comprising:

a vehicle body;

a lift frame supported so as to be rotatable about a lift axis with respect to the vehicle body;

a blade supported so as to be rotatable about a pitch axis with respect to the lift frame;

a lift actuator configured to cause the blade to perform a lift motion up and down about the lift axis;

a pitch actuator configured to cause the blade to perform a pitch motion about the pitch axis;

a sensor configured to detect a current blade tip position of the blade; and a controller configured to acquire actual topography data indicative of an actual topography to be worked, acquire target topography data indicative of a target topography, and control the lift actuator so that a blade tip of the blade moves according to the target topography, the controller being configured to control the pitch actuator so that a pitch angle of the blade is changed based on a positional relationship in a vertical direction between any two of the actual topography corresponding to the current blade tip position, the target topography corresponding to the current blade tip position, and the current blade tip position.

2. The work machine according to claim 1, wherein the controller is configured to control the pitch actuator so that the blade performs the pitch motion in a backward tilt direction when the target topography is positioned below a predetermined range in the vertical direction including the actual topography.

3. The work machine according to claim 2, wherein the controller is configured to acquire a height difference between the target topography and the actual topography, and change the pitch angle of the blade in the backward tilt direction according to an increase in the height difference when the target topography is positioned below the predetermined range.

4. The work machine according to claim 1, wherein the controller is configured to control the pitch actuator so that the blade performs the pitch motion in a forward tilt direction when the target topography is positioned above a predetermined range in the vertical direction including the actual topography.

5. The work machine according to claim 4, wherein the controller is configured to acquire a height difference between the target topography and the actual topography, and change the pitch angle of the blade in the forward tilt direction according to an increase in the height difference when the target topography is positioned above the predetermined range.

6. The work machine according to claim 1, wherein the controller is configured to control the pitch actuator so that the blade performs the pitch motion in a backward tilt direction when the target topography is positioned below a predetermined range in the vertical direction including the current blade tip position.

7. The work machine according to claim 6, wherein the controller is configured to acquire a height difference between the target topography and the current blade tip position, and change the pitch angle of the blade in the backward tilt direction according to an increase in the height difference when the target topography is positioned below the predetermined range.

8. The work machine according to claim 1, wherein the controller is configured to control the pitch actuator so that the blade performs the pitch motion in a forward tilt direction when the target topography is positioned above a predetermined range in the vertical direction including the current blade tip position.

9. The work machine according to claim 8, wherein the controller is configured to acquire a height difference between the target topography and the current blade tip position, and change the pitch angle of the blade in the forward tilt direction according to an increase in the height difference when the target topography is positioned above the predetermined range.

10. The work machine according to claim 1, wherein the controller is configured to control the pitch actuator so that the blade performs the pitch motion in a backward tilt direction when the current blade tip position is positioned below a predetermined range in the vertical direction including the actual topography.

11. The work machine according to claim 10, wherein the controller is configured to acquire a height difference between the current blade tip position and the actual topography, and change the pitch angle of the blade in the backward tilt direction according to an increase in the height difference when the current blade tip position is positioned below the predetermined range.

12. The work machine according to claim 1, wherein the controller is configured to control the pitch actuator so that the blade performs the pitch motion in a forward tilt direction when the current blade tip position is positioned above a predetermined range in the vertical direction including the actual topography.

13. The work machine according to claim 12, wherein the controller is configured to acquire a height difference between the current blade tip position and the actual topography, and change the pitch angle of the blade in the forward tilt direction according to an increase in the height difference when the current blade tip position is positioned above the predetermined range.

14. A method for controlling a work machine including a vehicle body, a lift frame supported so as to be rotatable about a lift axis with respect to the vehicle body, a blade supported so as to be rotatable about a pitch axis with respect to the lift frame, a lift actuator configured to cause the blade to perform a lift motion up and down about the lift axis, and a pitch actuator configured to cause the blade to perform a pitch motion about the pitch axis, the method comprising:

detecting a current blade tip position of the blade;

acquiring actual topography data indicative of an actual topography to be worked;

acquiring target topography data indicative of a target topography;

controlling the lift actuator so that a blade tip of the blade moves according to the target topography; and controlling the pitch actuator so that a pitch angle of the blade is changed based on a positional relationship in a vertical direction between any two of the actual topography corresponding to the current blade tip position, the target topography corresponding to the current blade tip position, and the current blade tip position.

15. The method according to claim 14, further comprising:

controlling the pitch actuator so that the blade performs the pitch motion in a backward tilt direction when the target topography is positioned below a predetermined range in the vertical direction including the actual topography.

16. The method according to claim 14, further comprising:

controlling the pitch actuator so that the blade performs the pitch motion in a forward tilt direction when the target topography is positioned above a predetermined range in the vertical direction including the actual topography.

17. The method according to claim 14, further comprising:

controlling the pitch actuator so that the blade performs the pitch motion in a backward tilt direction when the target topography is positioned below a predetermined range in the vertical direction including the current blade tip position.

18. The method according to claim 14, further comprising:

controlling the pitch actuator so that the blade performs the pitch motion in a forward tilt direction when the target topography is positioned above a predetermined range in the vertical direction including the current blade tip position.

19. The method according to claim 14, further comprising:

controlling the pitch actuator so that the blade performs the pitch motion in a backward tilt direction when the current blade tip position is positioned below a predetermined range in the vertical direction including the actual topography.

20. The method according to claim 14, further comprising:

controlling the pitch actuator so that the blade performs the pitch motion in a forward tilt direction when the current blade tip position is positioned above a predetermined range in the vertical direction including the actual topography.

* * * * *